US006659138B2

(12) United States Patent
Wendisch et al.

(10) Patent No.: US 6,659,138 B2
(45) Date of Patent: Dec. 9, 2003

(54) DEVICE FOR PRODUCING A TAPE HAVING A CURVE, ESPECIALLY A CURVED FLAT LINE COMPOUND

(75) Inventors: Klaus-Peter Wendisch, Dorfhain (DE); Gerhard Querner, Kreischass (DE)

(73) Assignee: PD-LAPP Systems GmbH (DE)

( * ) Notice: Subject to any disclaimer, the term of this patent is extended or adjusted under 35 U.S.C. 154(b) by 0 days.

(21) Appl. No.: 10/181,390

(22) PCT Filed: Jan. 11, 2001

(86) PCT No.: PCT/DE01/00230

§ 371 (c)(1),
(2), (4) Date: Sep. 25, 2002

(87) PCT Pub. No.: WO01/57296

PCT Pub. Date: Aug. 9, 2001

(65) Prior Publication Data

US 2003/0089415 A1 May 15, 2003

(30) Foreign Application Priority Data

Jan. 11, 2000 (DE) ..... 100 01 333

(51) Int. Cl.[7] ..... D03J 1/22
(52) U.S. Cl. ..... 139/293; 139/305; 139/386
(58) Field of Search ..... 139/305, 386, 139/293

(56) References Cited

U.S. PATENT DOCUMENTS

| | | | | | |
|---|---|---|---|---|---|
| 1,578,447 | A | * | 3/1926 | Lawton | 139/97 |
| 1,750,533 | A | * | 3/1930 | Ludorf | 139/305 |
| 1,770,740 | A | * | 7/1930 | Moore | 139/386 |
| 1,772,955 | A | * | 8/1930 | Moore | 139/421 |
| 2,424,411 | A | * | 7/1947 | Moore | 139/386 |
| 5,394,906 | A | * | 3/1995 | Farley | 139/192 |
| 5,415,205 | A | * | 5/1995 | Stenhouse | 139/192 |
| 5,523,141 | A | * | 6/1996 | Fyler | 428/108 |
| 6,089,281 | A | * | 7/2000 | Anderson | 139/448 |
| 6,453,951 | B1 | * | 9/2002 | Kuwabara | 139/33 |
| 6,575,201 | B2 | * | 6/2003 | Buesgen | 139/367 R |

FOREIGN PATENT DOCUMENTS

DE 198 16 666 10/1999

* cited by examiner

*Primary Examiner*—John J. Calvert
*Assistant Examiner*—Robert Muromoto, Jr.
(74) *Attorney, Agent, or Firm*—R W Becker & Associates; R W Becker

(57) ABSTRACT

The invention relates to a device for producing a tape having a curve, especially a curved flat line compound. The inventive device consists of several clamping jaw pairs that are arranged downstream in relation to a weaving device and serve for withdrawing the individual lines. The clamping jaw pairs are moveably arranged along the direction of withdrawal, are driven and can be swivelled. In a preferred embodiment, two clamping jaw pairs are used which can be moved to-and-fro along the direction of withdrawal in an alternating manner and by means of drives that engage on the ends of the clamping jaws. The amplitude of the movement can be changed in an independent manner on both sides. The drive device can be configured as a crank gear system. A crank gear engages on each side of each clamping jaw and the lifting movement of the crank gears of one side can be adjusted in relation to the lifting movement of the crank gears on the remaining side. Different warp threads (e.g. insulated copper lines, pneumatic hoses, reinforcement threads consisting of cord, steel or carbon, waveguide cables etc.) can be processed by means of the inventive device for forming flat cable forms which are particularly used in the aircraft and motor vehicle industries.

6 Claims, 6 Drawing Sheets

DEVICE FOR PRODUCING A TAPE HAVING A CURVE, ESPECIALLY A CURVED FLAT LINE COMPOUND

BACKGROUND OF THE INVENTION

The present invention relates to an apparatus for producing a band having a curve, especially, a curved flat composite cable, the apparatus being comprised of several clamping jaw pairs arranged downstream of a weaving device for withdrawing the individual lines which form the composite cable.

DE 198 16 666 A1 discloses the production of a band as woven composites with a curve in the plane of the weave. In this reference, an apparatus is also disclosed for the production of curved bands. The disclosed apparatus comprises a weft intake location of a narrow materials loom to which a gripper mechanism for clamping the warp threads with two gripping clamps is arranged. A clamping jaw pair, hereinafter referred to as grip clamps, is moveable and its jaws are driven and the other clamping jaw pair is fixed.

In order to weave a curve, the moveable grip clamps are closed to thereby clamp the warp threads, while the fixed grip clamps are opened. Then, the moveable grip clamps are moved about a rotation point, which leads to the result that the warp threads of the woven composite are moved during each cycle by an amount which increases from an angle which is nearer to the rotation point toward an angle of the grip clamps which is further from the rotation point. A curve is produced in the woven composite on the side toward the warp threads which are withdrawn by the relatively shorter amount. At the end of the movement, the fixed grip clamps are closed and the moveable grip clamps are opened and these moveable grip clamps return in a direction in opposition to the withdrawal direction back to their start position.

The course of movement is periodic. A curve is produced whose radius is given by the distance of the rotation point from the warp threads and whose sense of direction or handedness is given by the position to the right or the left of the warp threads relative to the position of the rotation point. To produce straight pieces, the moveable grip clamps are moved in a straight line manner.

The disadvantage of this apparatus is that the withdrawal process proceeds in a start-stop manner, in that, in connection with the movement of the moveable grip clamps back toward their start position, the transport of the warp threads must be abruptly interrupted. Particularly in connection with the working of warp threads of substantial mass, such as insulating electrical lines in comparison to pure textile yarns, strong fluctuations occur in the material which may be propagated up to the line building mechanism in the weaving machine or loom and, in connection with an increasing weft count, the production of a composite without problems or disturbances is increasingly impacted and is even fully impossible. Moreover, the apparatus permits only a very limited variation of the radii of the curves.

The present invention provides a solution to the challenge of providing a substantially uniform movement of the warp threads.

SUMMARY OF THE INVENTION

In accordance with the invention, this challenge is met in that all of the clamping jaw pairs are moveable relatively along the withdrawal direction and are driven and are pivoted.

In a preferred embodiment of the present invention, two clamping jaw pairs are arranged which are moveable back and forth along the extent of the withdrawal direction in alternating manner by means of a drive mechanism which engages the ends of the clamping jaws, whereby the amplitude of movement of both sides is independently variable.

The drive mechanism can preferably be comprised of a crank drive system, whereby, on each side of each clamping jaw, a crank drive engages and the stroke of the crank drive of one side relative to the stroke of the crank drive of the other side is adjustably variable.

In a further preferred embodiment of the present invention, a plurality of clamping jaws are arranged on one or more pairs of driven, endlessly circulating, non-rotatable drive means such that the clamping jaws are arranged in opposing manner by pairs. The clamping jaws comprise start cranks with sloping crank or start surfaces. Start rollers are provided adjacent the drive mechanism which are swingable into the path of movement of the start cranks. Elastic return movement elements, especially, spiral springs or flat springs, are preferably arranged between adjacent clamping jaws.

The drive mechanism, which is not extendable, comprises, preferably, roller chains or toothed drive chains. With the deployment of the inventive device, it is possible to use as warp thread differing material in order to meet the most stringent demands of the warp thread customer.

The warp threads are, for example, insulating copper lines, hoses for the conveyance of media and for pneumatic and hydraulic arrangements, armored or reinforced cords or yarns of cord, steel, carbon, or the like, light conducting cables, and similar materials.

The radii of the curves can be adjusted within a wide range which is not dependent upon the width of the clamping jaws. It is possible, for example, in correspondence with the demands of the aircraft and commercial vehicle industries, to finish or produce flat cables.

BRIEF DESCRIPTION OF THE DRAWINGS

The invention is described with the aid of the hereinafter following exemplary embodiment in more detail. In the accompanying drawings, it is shown.

DESCRIPTION OF PREFERRED EMBODIMENTS

Figure 1:
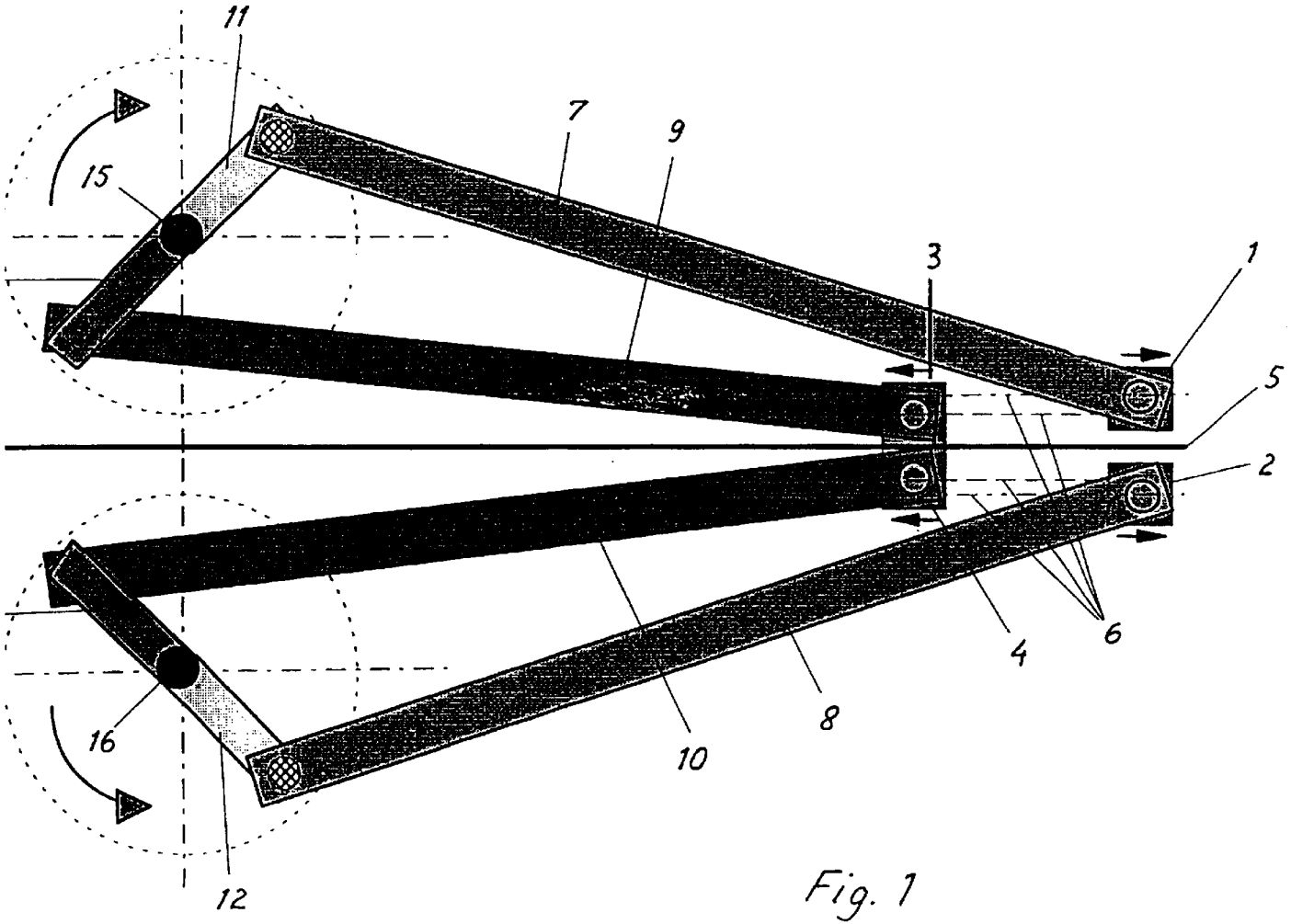
FIG. 1 is a side view of one embodiment of the device of the present invention with a crank drive.
Figure 2:
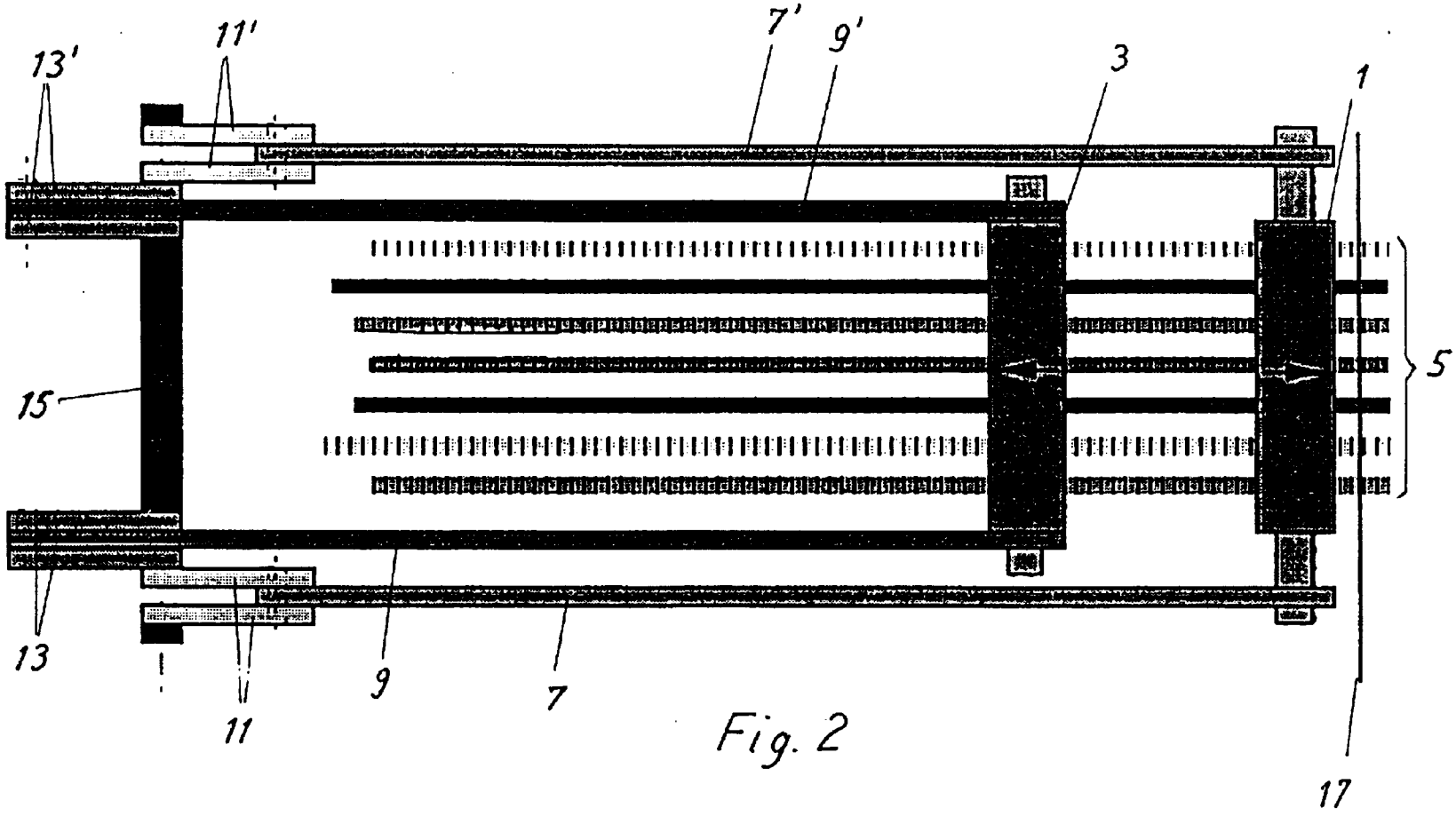
FIG. 2 is a plan view of the device shown in FIG. 1.

FIG. 1 shows a side view of a device in accordance with the present invention in combination with a narrow materials loom. The device comprises four clamping jaws 1, 2, 3, 4 of which respective ones are respectively paired with one another to thereby form two respective pairs of clamping jaws. Individual lines 5 extend between each respective pair of clamping jaws, the individual lines being the warp threads of a composite cable. Each clamping jaw is travels along a broken line-depicted path 6. A linkage rod 7, 7', 8, 8', 9, 9', 10, 10' engages the end of each clamping jaw to thereby couple the clamping jaw to a crank 11, 11', 12, 12', 13, 13', 14, and 14' (FIG. 1 and FIG. 2). The linkage rods 8' and 10' as well as the cranks 12' and 14' are not shown. The cranks of the upper clamping jaws 1, 3 are driven via the upper shaft 15 and the cranks of the lower clamping jaws are driven via the lower shaft 16. An offset of 180° is present between the cranks 11, 11', 12, 12' for the front clamping jaws 1 and 2 and the cranks 13, 13', 14, and 14 for the back clamping jaws. A weft infeed 17 (compare FIG. 2) is disposed in front of the front clamping jaws 1, 2.

The device operates as follows:

The upper shaft 16 is rotated in a clockwise direction and the lower shaft 16 is rotated in the counter clockwise direction. Due to this rotational movement, the pair of the front clamping jaws 1, 2 and the back clamping jaws 3, 4 move along the path 6 in alternating manner back and forth.

If a clamping jaw pair reaches the front dead point (adjacent the weft in-feed), the clamping jaw pair closes and engages the individual lines 5. At that instant, the other clamping jaw pair reaches the back dead point and opens. This operational condition is shown in FIG. 1. The arrows show the path of movement. The back clamping jaws 3,4 are located shortly before the back dead point and are in engagement with the individual lines 5, while the front clamping jaws 1,2 are located shortly before the front dead point and are open.

Figure 3:
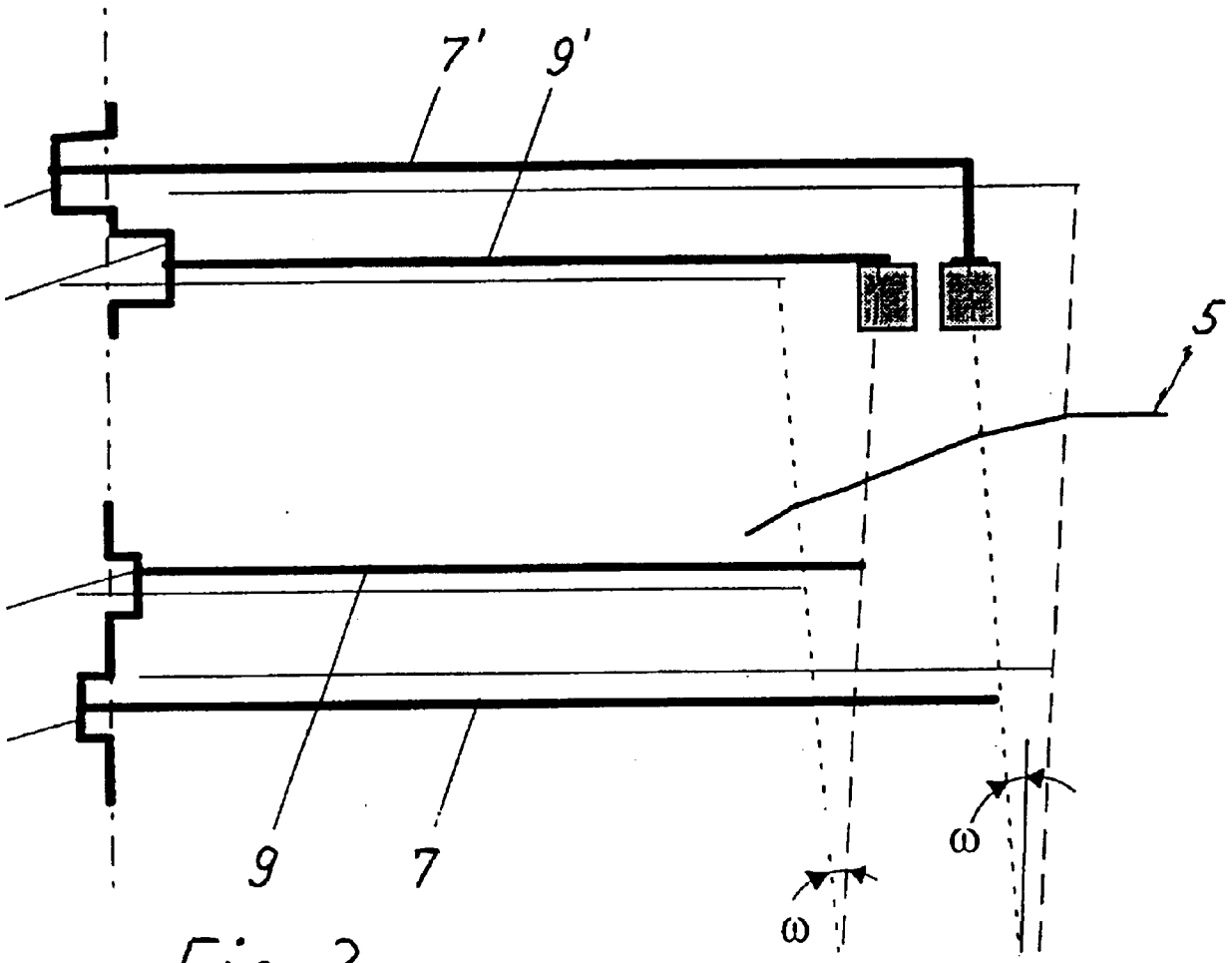
FIG. 3 is a view of the working principle of the withdrawal device shown in FIG. 1.

A curve is produced if the amplitude of movement of the linkage rods (the stroke) on one side of the clamping jaw pairs 1, 2, 3, 4 is different relative to that of the other side. FIG. 3 shows this operational condition. In this figure, for the purpose of providing a clearer overview, only the portion above the individual lines 5 is shown. The portion under the individual lines operate synchronously.

As seen in FIG. 3, the linkage rods 7, 9 have, as a result of a shorter adjusted crank 11, 13, a relatively smaller amplitude than the right linkage rods 7', 9' which are associated with the longer adjusted cranks 11', 13'. The start position of each clamping jaw pair is shown and (shown with a fine line) the end position of each clamping jaw pair within a half period of 0 to $\pi$.

The right individual lines are drawn off at a relatively greater length than the left individual lines. As a function of the size of the amplitude difference, there occurs a certain curve due to the size of the difference in the curve radius. During each period, the composite cable is curved through an angle $\omega$. The direction or handedness of curvature is determined by the side on which the amplitude in comparison to the opposed side has a smaller value.

The drive mechanism and the clamp mechanism are configured such that the curved composite cable can travel sideways in a problem-free manner. To improve the intake of the withdrawal force on the individual lines, the clamping jaws can be configured with a profile corresponding to the circumferential profile of the individual lines.

Figure 4:
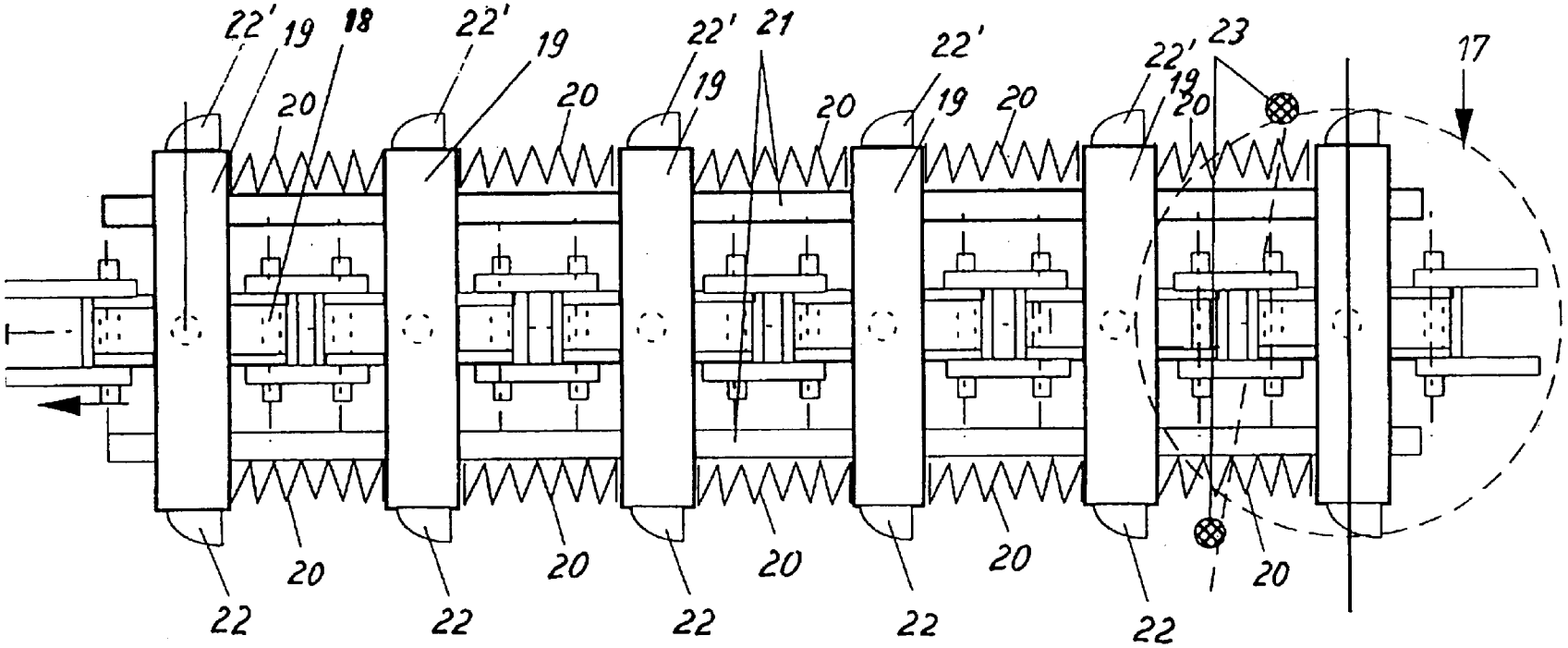
FIG. 4 is a view of the lower portion of a withdrawal device having a chain drive.

FIG. 4 shows the lower portion of a withdrawal device having a roller chain drive. This roller chain drive comprises a lower chain 18. The clamping jaws 19 are mounted at uniform spacings from one another in pivoting manner to the lower chain 18. The clamping jaws 19 are connected to one another via spiral springs 20 and are supported against a press band 21. In addition to the clamping jaws, start cranks 22, 22' are provided. The start cranks have a sloped and bent start surface. Start rollers 23 are provided on the right and left for movement in a swinging manner into the movement path of the start cranks. The individual lines 5 (FIG. 5) travel over the lower portion of the withdrawal device.

Figure 5:
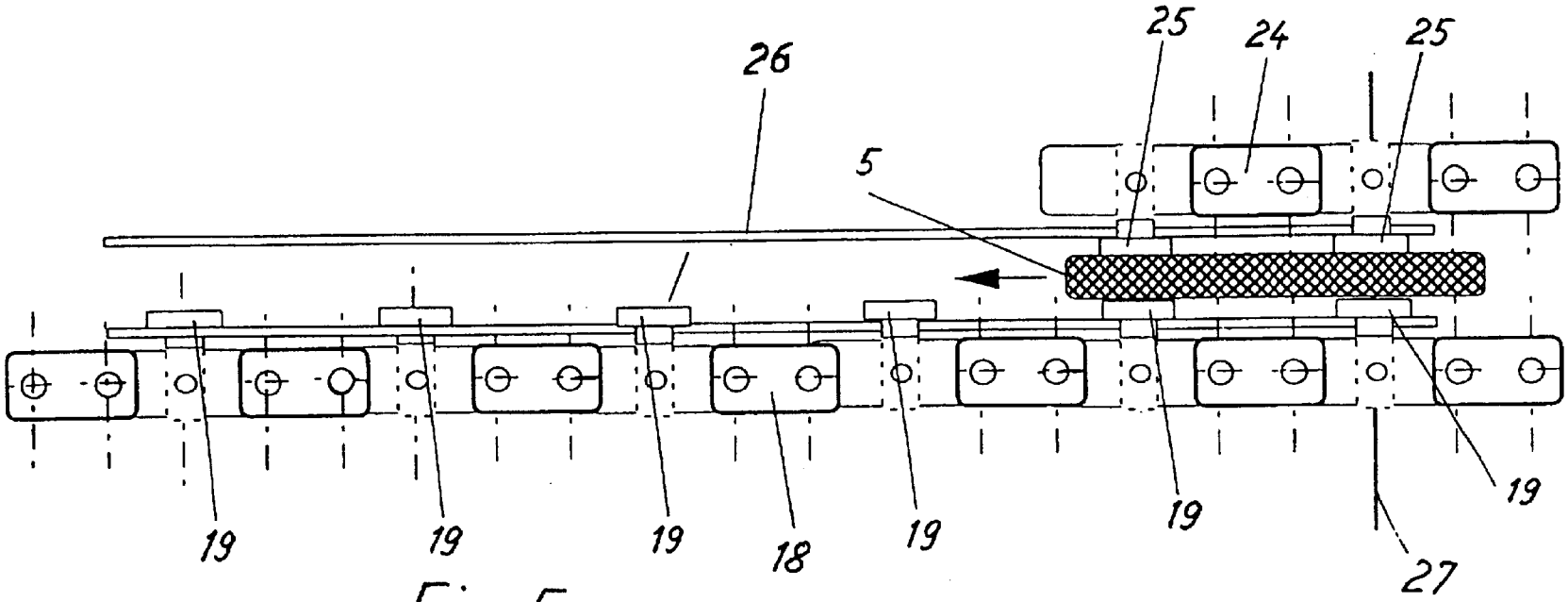
FIG. 5 is a side view of the withdrawal device shown in FIG. 4.

In FIG. 5, there is shown a mirror image view of the upper portion of the withdrawal device. The upper chain 24 can be seen with the upper clamping jaws 25 which are supported against the upper press band 26. The lower clamping jaws 19 and the upper clamping jaws 25 are arranged in opposing manner to one another on the chains.

The chains travel in an endless loop in the withdrawal direction. They apply the linear withdrawal force on the individual lines. The fixing of the beginning of clamping occurs through the two press bands 21, 26 on the clamping jaws 19, 25. The clamping jaws are arranged, such as shown in FIG. 5, on the clamping line 27 such that the individual lines are clamped at the clamping line 27 between the upper clamping jaws 19 and the synchronously traveling lower clamping jaws at 25.

Figure 6:
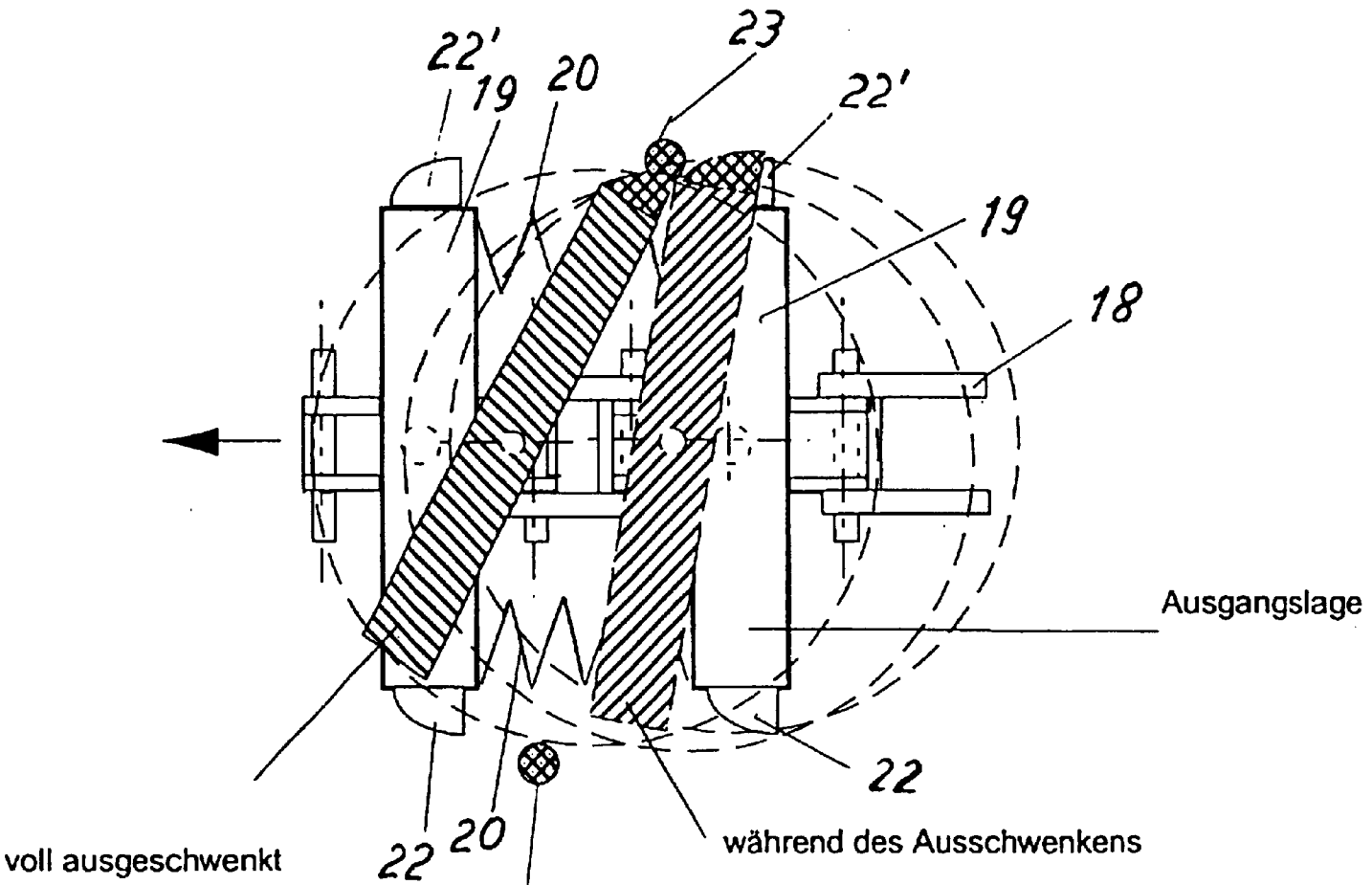
FIG. 6 is a view of the swing movement of the clamping jaws of a withdrawal device having a chain drive.

FIG. 6 shows the pivot of the clamping jaws. Also here, for the purpose of a clearer overview, only a portion of the lower portion of the drive mechanism is shown. The upper portion of the drive mechanism executes the same movement in a synchronous manner. The clamping jaws 19, 25 engage the individual lines 5 initially parallel to the weft feed intake at the clamping line. Immediately after the clamping, a clamping jaw extends with the right start crank 22' against the right start roller. In conjunction with a further movement of the chain, the clamping jaw is forced into a pivot movement and, indeed, is pivoted to such an extent that it eventually slides by the start roller. The position of a clamping jaw is shown during the pivoting and fully pivoted out with cross-hatching.

Due to the coupling between the clamping jaws by means of the spiral springs 20, those clamping jaws, which lie in the travel direction of the chain ahead of the engaged clamping jaw, are also moved as well. Optionally, deployable additional start rollers can be provided as well for this purpose. In this manner, it is achieved that the tension in the material can be maintained for a longer duration than only during the time at which it passes the clamping line.

The thus-produced pivoting of the clamping jaws 19, 25 around the start crank 22' effects different withdrawal of the materials along the width of all of the individual lines 5 and thus ensures the creation of a curve.

Different clamping jaw configurations and thereby different curve radii can be achieved through more or less strong backward movement of the start rollers, as is schematically shown in FIG. 6.

Different senses of directions or handedness occur through the pivoting of the start roller 23 to the opposed side during simultaneous pivoting of the respective opposed start roller.

The clamping is released at a pre-determined distance from the clamp line selected with respect to the length of the press bands 21, 26, in that the press bands end or bend away. The clamping jaws are then returned to their start positions by the spiral springs 20.

The specification incorporates by reference the disclosure of German priority documents 100 01 333.3 filed Jan. 11, 2000 and PCT/DE01/00230 filed Jan. 11, 2001.

The present invention is, of course, in no way restricted to the specific disclosure of the specification and drawings, but also encompasses any modifications within the scope of the appended claims.

| Overview of Reference Numbers | |
|---|---|
| 1 | upper front clamping jaw |
| 2 | lower front clamping jaw |
| 3 | upper back clamping jaw |
| 4 | lower back clamping jaw |
| 5 | individual lines |
| 6 | paths |
| 7 | linkage rod |
| 7' | linkage rod |
| 8 | linkage rod |
| 8' | linkage rod |
| 9 | linkage rod |
| 9' | linkage rod |

-continued

| Overview of Reference Numbers | |
|---|---|
| 10 | linkage rod |
| 10' | linkage rod |
| 11 | crank |
| 11' | crank |
| 12 | crank |
| 12' | crank |
| 13 | crank |
| 13' | crank |
| 14 | crank |
| 14' | crank |
| 15 | upper shaft |
| 16 | lower shaft |
| 17 | weft infeed |
| 18 | lower chain |
| 19 | upper clamping jaws |
| 20 | spiral spring |
| 21 | lower press band |
| 22 | start cams |
| 22' | start cams |
| 23 | start roller |
| 24 | upper chain |
| 25 | upper clamping jaws |
| 26 | upper press band |
| 27 | clamping line |

What is claimed is:

1. An apparatus for producing a band with a curve, especially, a curved flat composite cable, the apparatus comprising:

a plurality of clamping jaw pairs arranged downstream of a web device for withdrawing the individual lines which form the composite cable, each respective pair of clamping jaws being moveable relatively along the withdrawal direction of the individual lines, drivable between its open and closed positions, and pivotable about an axis generally perpendicualr to the travel path of the individual lines being withdrawn.

2. An apparatus according to claim 1, wherein two clamping jaw pairs are arranged which are moveable back and forth along the extent of the withdrawal direction in alternating manner by means of a drive mechanism which engages the ends of the clamping jaws, whereby the amplitude of movement of both sides is independently variable.

3. An apparatus according to claim 2, wherein the drive mechanism is a crank drive system, whereby a crank drive engages each side of each clamping jaw and whereby the stroke of the crank drive of one side relative to the stroke of the crank drive of the other side is adjustably variable.

4. An apparatus according to claim 1, wherein a plurality of the clamping jaws are arranged on one or more pairs of driven, endlessly circulating, non-rotatable drive means such that the clamping jaws are arranged in opposing manner by pairs, the clamping jaws include start cranks with sloping surfaces, and start rollers are provided adjacent the drive mechanism which are swingable into the path of movement of the start cranks.

5. An apparatus according to claim 4, wherein elastic return movement elements, especially, spiral springs or flat springs, are arranged between adjacent clamp jaws.

6. An apparatus according to claim 4, wherein the drive mechanism, which is not extendable, comprises roller chains or toothed drive chains.

* * * * *

UNITED STATES PATENT AND TRADEMARK OFFICE

CERTIFICATE OF CORRECTION

PATENT NO. : 6,659,138 B2
DATED : December 9, 2003
INVENTOR(S) : Wendisch et al.

It is certified that error appears in the above-identified patent and that said Letters Patent is hereby corrected as shown below:

Title page,
Item [54], should read as follows:

-- [54] Title: APPARATUS FOR PRODUCING A BAND HAVING A CURVE, ESPECIALLY A CURVED FLAT COMPOSITE CABLE --

Signed and Sealed this

Sixteenth Day of March, 2004

JON W. DUDAS
*Acting Director of the United States Patent and Trademark Office*